US011373855B2

(12) United States Patent
Yagyu

(10) Patent No.: US 11,373,855 B2
(45) Date of Patent: Jun. 28, 2022

(54) EXCIMER LAMP

(71) Applicant: Ushio Denki Kabushiki Kaisha, Tokyo (JP)

(72) Inventor: Hideaki Yagyu, Tokyo (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/397,661

(22) Filed: Aug. 9, 2021

(65) Prior Publication Data

US 2022/0068628 A1 Mar. 3, 2022

(30) Foreign Application Priority Data

Aug. 28, 2020 (JP) ..... JP2020-144409

(51) Int. Cl.
*H01J 61/54* (2006.01)
*H01J 61/12* (2006.01)
(Continued)

(52) U.S. Cl.
CPC ..... *H01J 61/547* (2013.01); *H01J 61/125* (2013.01); *H01J 61/16* (2013.01); *H01J 61/302* (2013.01)

(58) Field of Classification Search
CPC ..... H01J 61/547; H01J 61/125; H01J 61/16; H01J 61/12; H01J 65/046
See application file for complete search history.

(56) References Cited

U.S. PATENT DOCUMENTS 5,889,367 A 3/1999 Hofmann et al.

FOREIGN PATENT DOCUMENTS

JP 2001-185090 A 7/2001
JP 2010205639 A * 9/2010 ..... H01J 65/00
JP 2014-049280 A 3/2014

OTHER PUBLICATIONS

An Office Action; "Notice of Reasons for Rejection", mailed by the Japanese Patent Office dated Jul. 6, 2021, which corresponds to Japanese Patent Application No. 2020-144409 and is related to U.S. Appl. No. 17/397,661; with English language translation.

(Continued)

*Primary Examiner* — Donald L Raleigh
(74) *Attorney, Agent, or Firm* — Studebaker & Brackett PC

(57) ABSTRACT

An excimer lamp includes a discharge vessel in which a rare gas and a halogen are enclosed. The excimer lamp also includes at least one first electrode and at least one second electrode for generating a dielectric barrier discharge inside the discharge vessel. The discharge vessel has a discharge forming region and a non-discharge region such that discharging takes place in the discharge forming region and no discharging takes place in the non-discharge region. The discharge forming region is formed between the first electrode(s) and the second electrode(s). The non-discharge region communicates with the discharge forming region. The excimer lamp satisfies a following equation:

$$(Vb \times Ph)/Sd \geq 4.50$$

where Vb [$mm^3$] represents a space volume inside the discharge vessel, Sd [$mm^2$] represents an inner surface area of the discharge vessel in the discharge forming region, and Ph [Torr] represents a halogen-atoms partial pressure enclosed in the discharge vessel.

15 Claims, 10 Drawing Sheets

(51) Int. Cl.
*H01J 61/16* (2006.01)
*H01J 61/30* (2006.01)

(56) References Cited

OTHER PUBLICATIONS

An Office Action mailed by China National Intellectual Property Administration dated Jan. 27, 2022, which corresponds to Chinese Patent Application No. 202110555473.8 and is related to U.S. Appl. No. 17/397,661; with English language translation.

* cited by examiner

FIG. 5

| NO. | Ph [Torr] | D [mm] | L [mm] | F [mm] | Se [mm²] | Sb [mm²] | Se/Sb | Vd [mm³] | Sd [mm²] | Vb [mm³] | Vd/Vb | M =Vb×Ph | M/Sd [Torr · mm] | LIFE [hour] |
|---|---|---|---|---|---|---|---|---|---|---|---|---|---|---|
| 1 | 3.0 | 35 | 35 | 4 | 352 | 440 | 0.80 | 440 | 440 | 440 | 1.00 | 1319 | 3.00 | 150 |
| 2 | 4.0 | 40 | 40 | 4 | 414 | 502 | 0.83 | 502 | 502 | 502 | 1.00 | 2010 | 4.00 | 800 |
| 3 | 1.2 | 55 | 40 | 4 | 414 | 691 | 0.60 | 502 | 502 | 691 | 0.73 | 829 | 1.65 | 60 |
| 4 | 2.0 | 55 | 40 | 4 | 414 | 691 | 0.60 | 502 | 502 | 691 | 0.73 | 1382 | 2.75 | 200 |
| 5 | 3.2 | 55 | 40 | 4.5 | 466 | 777 | 0.60 | 636 | 565 | 874 | 0.73 | 2798 | 4.95 | 1650 |
| 6 | 2.0 | 105 | 80 | 4 | 917 | 1319 | 0.70 | 1005 | 1005 | 1319 | 0.76 | 2638 | 2.63 | 250 |
| 7 | 2.6 | 55 | 40 | 4 | 414 | 691 | 0.60 | 502 | 502 | 691 | 0.73 | 1796 | 3.58 | 500 |
| 8 | 3.0 | 60 | 40 | 4 | 414 | 754 | 0.55 | 502 | 502 | 754 | 0.67 | 2261 | 4.50 | 2100 |
| 9 | 1.4 | 60 | 40 | 4 | 414 | 754 | 0.55 | 502 | 502 | 754 | 0.67 | 1055 | 2.10 | 150 |
| 10 | 1.4 | 60 | 40 | 4 | 414 | 754 | 0.55 | 502 | 502 | 754 | 0.67 | 1055 | 2.10 | 200 |
| 11 | 2.8 | 67 | 40 | 4 | 414 | 842 | 0.49 | 502 | 502 | 842 | 0.60 | 2356 | 4.69 | 2200 |
| 12 | 3.2 | 70 | 40 | 4.5 | 466 | 989 | 0.47 | 636 | 565 | 1113 | 0.57 | 3561 | 6.30 | 2500 |
| 13 | 3.7 | 70 | 40 | 4.5 | 466 | 989 | 0.47 | 636 | 565 | 1113 | 0.57 | 4117 | 7.28 | 2500 |
| 14 | 5.0 | 70 | 40 | 4.5 | 466 | 989 | 0.47 | 636 | 565 | 1113 | 0.57 | 5564 | 9.84 | 2500 |
| 15 | 1.6 | 110 | 40 | 4.5 | 466 | 1554 | 0.30 | 636 | 565 | 1749 | 0.36 | 2798 | 4.95 | 2000 |

Ph: Cl-ATOM PARTIAL PRESSURE
D: TOTAL LENGTH
L: DISCHARGE LENGTH
F: INNER DIAMETER
Se: ELECTRODE CONTACT AREA
Sb: INNER SURFACE AREA OF THE BULB
Se/Sb: RATIO OF ELECTRODE CONTACT AREAS

Vd: DISCHARGE SPACE
Sd: SURFACE AREA OF THE DISCHARGE SPACE
Vb: BULB VOLUME
Vd/Vb: RATIO OF SPACE VOLUMES
M: AMOUNT OF Cl LOADED (VbxPh)

EXCIMER LAMP

TECHNICAL FIELD

The present invention relates to an excimer lamp that has a discharge vessel in which a rare gas and a halogen are sealedly enclosed.

DESCRIPTION OF THE RELATED ART

A typical conventional excimer lamp has a gas container that encloses a rare gas and a halogen as light emitting gases.

The excimer lamp in which the rare gas and the halogen are enclosed has a characteristic emission wavelength depending on the combination of the rare gas and the halogen. For example, a combination of the rare gas (xenon (Xe) or krypton (Kr)) and the halogen (chlorine (Cl) or bromine (Br)) exhibits diverse emission with a central wavelength in a range from approximately 200 nm to approximately 300 nm.

The unique emission wavelength obtained by such a combination of a rare gas and halogen is derived from the emission of an excited complex (exciplex) formed by rare gas atoms and halogen atoms, and is expected to be used in various applications.

On example of light emission caused by the exciplex will be described with reference to FIG. 18 of the accompanying drawings. In the example illustrated in FIG. 18, krypton (Kr) is used as a rare gas and chlorine (Cl) is used as a halogen. As shown in FIG. 18, the krypton (Kr) present in a discharge forming region A is excited or ionized by the electrons emitted upon the discharging that takes place in the discharge forming region A, such that the krypton becomes Kr*. Then, Kr* collides with the chlorine (Cl) present in the discharge forming region A to generate KrCl* (krypton chloride exciplex). KrCl* is a very unstable compound and therefore separates into krypton (Kr) and chlorine (Cl) in a short time. When KrCl* separates into krypton (Kr) and chlorine (Cl), it produces an intrinsic emission (excimer emission) L.

Incidentally, an excimer lamp that uses chlorine as a halogen of a light emitting gas has a problem that illuminance tends to drop in a short time and a light emitting life is short. This is because chlorine used for the light emitting gas has a high energy upon ionization or excitation such that the chlorine is driven into the bulb a of the discharge vessel (the quartz glass member) and disappears from the discharge forming region A.

For example, Japanese Patent Application Laid-Open Publication No. 2014-49280 discloses an excimer lamp that has a discharge vessel made of glass. In the discharge vessel, chlorine is sealed as a discharge gas. In order to suppress chlorine from being taken into the quartz glass of the discharge vessel over the time of lighting as much as possible, a longitudinal side edge portion of a planar portion of the discharge vessel is bulged outward in the discharge gap direction.

SUMMARY OF THE INVENTION

However, the technique described in Japanese Patent Application Laid-Open Publication No. 2014-49280 provides a limited effect of suppressing the loss of chlorine, and is not applicable to various types of discharge vessels. Therefore, it is insufficient as the technique for suppressing the loss of chlorine.

Accordingly, one object of the present invention is to provide an improvement to an excimer lamp that has a discharge vessel in which a rare gas and a halogen are enclosed.

In order to solve the above-described problems, an excimer lamp according to one aspect of the present invention includes a discharge vessel in which a rare gas and a halogen are enclosed and sealed as light emitting gases. The excimer lamp also includes at least one first electrode and at least one second electrode for generating a dielectric barrier discharge inside the discharge vessel. The rare gas is xenon or krypton. The discharge vessel has a discharge forming region and a non-discharge region (no-discharging region) therein such that discharging takes place in the discharge forming region and the discharging does not take place in the non-discharge region. The non-discharge region may be referred to as a no-discharge forming region. The discharge forming region is formed between the first electrode(s) and the second electrode(s). The non-discharge region communicates with the discharge forming region. The excimer lamp is configured to satisfy a following formula:

$$(Vb \times Ph)/Sd \geq 4.50$$

where Vb [$mm^3$] represents a space volume inside the discharge vessel, Sd [$mm^2$] represents an inner surface area of the discharge vessel in the discharge forming region, and Ph [Torr] represents a halogen-atoms partial pressure enclosed in the discharge vessel.

The above-described configuration is devised and developed from the following considerations (1) to (3). (1) The halogen disappearance is influenced by the magnitude of the surface area of the space that serves as the discharge forming region, i.e., the inner surface area of the discharge vessel in the region where the discharge is formed. (2) As the space volume of the non-discharge region increases, the space in which halogen is not excited expands in the discharge vessel, and it is possible to keep the halogen in the discharge vessel without being excited. In other words, it can be considered that a certain amount of halogen is intentionally retained in the discharge vessel without being consumed. (3) By loading and enclosing a sufficient amount of halogen in the discharge forming region where the disappearance of halogen occurs, it is possible to improve (prolong) the light emitting life of the excimer lamp.

Using the above-indicated formula derived from the above-described considerations, the inventor found that good life characteristics were obtained when the condition of $(Vb \times Ph)/Sd \geq 4.50$ is satisfied.

If the partial pressure of halogen atoms in the discharge vessel becomes high, the startup performance (how smooth the lighting starts) of the excimer lamp deteriorates. In some cases, lighting cannot be performed. In particular, when chlorine is used as a light emitting gas, the deterioration of the startup performance becomes significant. In the present invention, however, the halogen is not excited but retained in the non-discharge region. Thus, even if the partial pressure of halogen atoms in the discharge vessel is not very high, it is easy to keep a sufficient amount of halogen in the discharge vessel for use in the discharge forming region. It is possible to obtain the good lifetime property of the excimer lamp by deciding the inner surface area Sd [$mm^2$] of the discharging space, the non-discharge region [$mm^3$], and the halogen-atoms partial pressure [Torr] on the basis of the above-indicated formula.

In this specification, the halogen-atoms partial pressure is a partial pressure obtained by calculating, in terms of atoms, an amount of halogen contained in a gas-phase halogen compound or a halogen gas. For example, when the halogen atom number (X) of the gas-phase molecule ($H_X$ or $A{\cdot}H_X$) containing the halogen atom (H) is 1, the partial pressure of the gas-phase molecule enclosed in the discharge vessel is the halogen-atoms partial pressure. If the number of halogen atoms (X) contained in the gas-phase molecule is 2, a value obtained by doubling the enclosed gas partial pressure of the gas-phase molecule becomes a halogen-atoms partial pressure.

If the halogen atom is a chlorine atom and the gas-phase molecule is hydrogen chloride (HCl), the enclosed gas partial pressure corresponds to the halogen-atoms partial pressure. If the halogen atom is a chlorine atom and the gas-phase molecule is a chlorine gas ($Cl_2$), a value obtained by doubling the enclosed gas partial pressure corresponds to the halogen-atoms partial pressure.

In the above-described excimer lamp, the space volume of the discharge forming region may be equal to or smaller than 73% of the space volume inside the discharge vessel including the discharge forming region and the non-discharge region. This can provide a large size of non-discharge region. By increasing the ratio of the non-discharge region to the discharge vessel (i.e., by increasing the ratio of the space volume of the non-discharge region to the space volume inside the discharge vessel), it is possible to increase an amount of halogen enclosed in the discharge vessel while suppressing the halogen-atoms partial pressure. In addition, since the ratio of the non-discharge region to the discharge forming region is increased, there are the following advantages.

Even if the halogen excited in the discharge forming region is driven into the discharge vessel and decreased from the inside of the discharge vessel, the halogen-atoms partial pressure in the discharge vessel is hardly changed because the discharge vessel has a sufficiently large non-discharge region, in which the halogen is not excited. This suppresses a change in the halogen-atoms partial pressure and reduces a change in the lighting characteristics due to the change in the halogen-atoms partial pressure. Further, this suppresses a change in the partial pressure ratio of the halogen-atoms partial pressure to the rare gas partial pressure, thereby reducing a decrease in the illuminance of the excimer lamp.

In the above-described excimer lamp, the space volume of the discharge forming region may be equal to or smaller than 60% of the space volume inside the discharge vessel including the discharge forming region and the non-discharge region. This can enhance the above-mentioned effects.

In the above-described excimer lamp, it is preferable that the first electrode(s) and the second electrode(s) are disposed in contact with an outer surface of the discharge vessel. If the electrodes are provided inside the discharge vessel (light emitting tube), halogen in the light emitting gas is easily absorbed by the electrodes. By disposing the electrodes outside the discharge vessel, it is possible to suppress the absorption of halogen.

In the above-described excimer lamp, a contact area between the discharge vessel and the first and second electrodes may be equal to or smaller than 50% of an outer surface area of the discharge vessel. Even when the electrodes are provided on the outer surface of the discharge vessel, the excited halogen tends to gather and be driven into that region of the discharge vessel which is in contact with the electrodes. By reducing the contact area between the discharge vessel and the electrodes, it is possible to suppress the implantation of halogen into the discharge vessel and reduce the consumption of halogen.

In the above-described excimer lamp, the halogen may be a chlorine gas. If the halogen is a chlorine gas and the rare gas is xenon, the excimer lamp can emit excimer light having a central wavelength of 308 nm. If the halogen is a chlorine gas and the rare gas is krypton, the excimer lamp can emit excimer light having a center wavelength of 222 nm.

In the above-described excimer lamp, the discharge vessel may be made of quartz glass. Even if the discharge vessel is made of quartz glass, it is possible to suppress the disappearing of excited halogen, and it is possible to appropriately extend the light emitting life of the excimer lamp.

As described above, the present invention can provide an improvement to the excimer lamp in which a rare gas and a halogen are enclosed in a discharge vessel.

BRIEF DESCRIPTION OF THE DRAWINGS

FIG. 5 shows a verification experiment result.

DETAILED DESCRIPTION OF EMBODIMENTS

Embodiments of the present disclosure will be described below with reference to the drawings.

Figure 1:
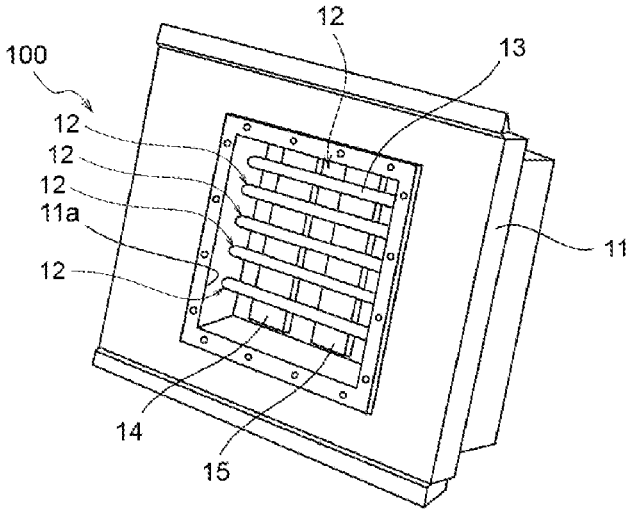
FIG. 1 is a schematic outside view of a light source device including a plurality of excimer lamps according to an embodiment of the present invention.
Figure 2:
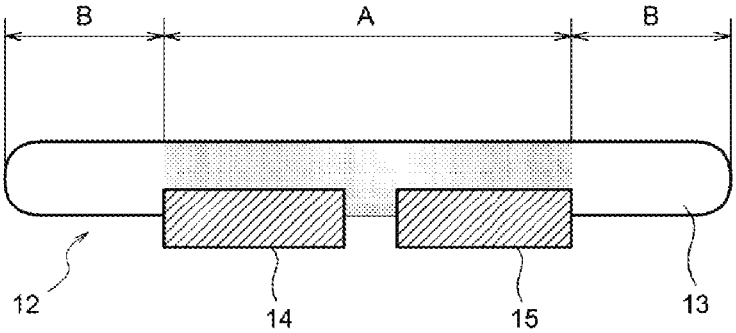
FIG. 2 schematically shows one of the excimer lamps shown in FIG. 1.
Figure 3:
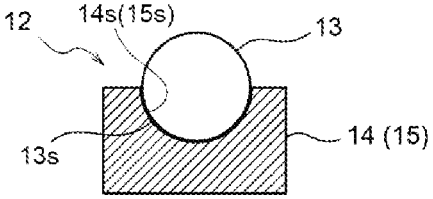
FIG. 3 schematically shows the excimer lamp of FIG. 2 when viewed in an axial direction of a light emitting tube (discharge vessel) of the excimer lamp.

FIG. 1 is a schematic appearance view of a light source device (device for emitting ultraviolet light) 100 including a plurality of excimer lamps 12 according to an embodiment of the present invention. FIG. 2 schematically shows one of the excimer lamps 12 of this embodiment, and FIG. 3 is a schematic view of the excimer lamp 12 shown in FIG. 2 when viewed in the axial direction of a tube of the excimer lamp.

As shown in FIG. 1, the light source device 100 includes a housing 11, and the five excimer lamps 12 arranged in parallel inside the housing 11. The five excimer lamps 12 have the same configuration. The excimer lamps 12 extend in a generally horizontal direction.

The housing 11 has an opening 11*a* that serves as a light exit window (irradiation window). A window member made of, for example, quartz glass, may be provided in the opening 11*a*. An optical filter for blocking unnecessary light may also be provided in the opening 11*a*. The light exit surface (plane) of each of the excimer lamps 12 faces the light exit window. The light exit surface of the excimer lamp 12 may be referred to as a front surface of the excimer lamp 12.

It should be noted that the light source device 100 shown in FIG. 1 includes the five excimer lamps 12, but the number of excimer lamps 12 is not limited to five.

Each of the excimer lamps 12 includes a discharge vessel 13 having a straight tube shape, and both ends of the discharge vessel 13 are hermetically sealed. The discharge vessel 13 is made of quartz glass. A rare gas and a halogen gas are sealedly enclosed, as light emitting gases, in the discharge vessel 13. In this embodiment, krypton (Kr) is used as the rare gas, and chlorine gas ($Cl_2$) is used as the halogen gas.

It should be noted that xenon (Xe) may be used as the rare gas, and bromine (Br) may be used as the halogen gas.

A pair of electrodes, i.e., a first electrode 14 and a second electrode 15, are disposed in the discharge vessel 13. The first electrode 14 and the second electrode 15 extend in parallel to each other in a generally vertical direction. The first electrode 14 and the second electrode 15 are in contact with the outer surface (rear surface) of each of the discharge vessels 13. As shown in FIG. 2, the first electrode 14 and the second electrode 15 are arranged on the rear surface of the discharge vessel 13 (the lower surface of FIG. 2), which is opposite to the light exit surface (the light emitting surface or the front surface) of the discharge vessel 13 such that the first electrode 14 is spaced from the second electrode 15 in the axial direction of the tube shape of the discharge vessel 13 (the right-left direction of FIG. 2).

The discharge vessel 13 spans the two electrodes 14 and 15 while being in contact with the two electrodes 14 and 15. Specifically, each of the two electrodes 14 and 15 has a concave portion or a groove 14*s*, 15*s*, as shown in FIG. 3. The discharge vessel 13 is fitted into the grooves 14*s* and 15*s* of the electrodes 14 and 15. As a result, the discharge vessel 13 has a contact surface 13*s* for contact with the electrodes 14 and 15, as shown in FIG. 3.

Of the two electrodes 14 and 15, one electrode (e.g., the first electrode 14) is a high-voltage electrode, and the other electrode (e.g., the second electrode 15) is a low-voltage electrode (ground electrode). By applying a high-frequency voltage across the first electrode 14 and the second electrode 15, an excited complex is generated in the inner space of the discharge vessel 13, and excimer light having a center wavelength of 222 nm is emitted from the light exit surface of the excimer lamp 12.

As shown in FIG. 2, a region from the first electrode 14 and to the second electrode 15 inside the discharge vessel 13 in the axial direction of the discharge vessel 13 is a discharge forming region A in which the discharge is formed. Non-discharge regions B and B are formed on opposite sides of the discharge forming region A such that the non-discharge regions B and B communicate with the discharge forming region A in the axial direction of the discharge vessel 13. The two regions B and B are defined on the right and left sides of the discharge vessel 13 in the axial direction of the discharge vessel 13, respectively.

The discharge forming region A is a region in the inner space of the discharge vessel 13, in which the discharge is formed and light is emitted upon activating the excimer lamp.

It should be noted that the discharge forming region A is not limited to the one shown in FIG. 2. If the two electrodes (the first electrode 14 and the second electrode 15) are disposed on the outer surface of the discharge vessel 13 and face each other across the inner space of the discharge vessel 13, the inner space sandwiched between the two electrodes 14 and 15 is the discharge forming region A.

Alternatively, if the two electrodes (first electrode and second electrode) are disposed on the outer surface of the discharge vessel 13 at different positions in the extending direction (axial direction, longitudinal direction, radial direction, height direction, width direction) of the discharge vessel 13, the inner space of the discharge vessel 13 from the first electrode 14 to the second electrode 15 is the discharge forming region A.

If the first and second electrodes are disposed on the front surface and the rear surface of the discharge vessel 13, respectively, (e.g., the first electrode 14 is disposed on the front surface and the second electrode 15 is disposed on the rear surface,) and the position of the first electrode 14 is different from the position of the second electrode 15 in the axial direction of the discharge vessel 13, the inner space lying between the first and second electrodes is the discharge forming region A.

Incidentally, in an excimer lamp in which a rare gas and a halogen are sealed inside a discharge vessel, the halogen is driven into the quartz glass of the discharge vessel. This phenomenon (halogen being driven into the discharge vessel) is a phenomenon in which the halogen excited upon discharging reacts with the quartz glass of the discharge vessel and enters the quartz glass. If the halogen is reduced or disappeared from the discharge forming region A inside the discharge vessel due to this phenomenon, the illuminance of light emitted from the excimer lamp drops. In particular, the excited chlorine atoms tend to enter the quartz glass. Thus, if the chlorine atoms are used as the light emitting gas, the illuminance tends to decrease.

It would be possible to increase an amount of halogen to be loaded (enclosed) into the discharge vessel on the assumption that halogen could possibly decrease or disappear. However, if a larger amount of halogen is enclosed into the discharge vessel, the ratio of the halogen (gas) to the rare gas changes from an appropriate ratio, and this could greatly affect the lighting characteristics (startup performance or smooth starting of light emission) and the life characteristics of the excimer lamp.

Specifically, if an amount of halogen enclosed in the discharge vessel increases, the pressure of the halogen enclosed in the discharge vessel becomes high and a higher voltage is required for the starting. As a result, the excimer lamp is difficult to start or cannot emit any light in the worst scenario. In addition, if the ratio of the halogen to the rare gas becomes too large, electrons are easily taken by halogen, which inhibits the formation of excited complexes and lowers the illuminance Thus, when the ratio of the halogen to the rare gas shifts from an appropriate ratio, it is difficult to provide a stable light source.

The present inventor intensively studied an appropriate pressure of the halogen in the discharge vessel of the excimer lamp and found that the life characteristics of the excimer lamp can be improved by the following scheme. Specifically, forming a region or regions (non-discharge region(s) B) in which no discharge takes place in the discharge vessel, and deciding the discharge forming region and the non-discharge region(s) together with the gas pressure of the halogen enclosed in the discharge vessel such that the condition of $Vb \times Ph/Sd \geq 4.50$ is satisfied where Vb [$mm^3$] represents the volume of the space inside the discharge vessel including the non-discharge region(s), Sd [$mm^2$] represents the inner surface area of the discharge vessel in the discharge forming region and Ph [Torr] represents the partial pressure of halogen atoms loaded in the discharge vessel.

Hereinafter, a point that the space volume of the discharge vessel including the non-discharge regions is considered will be described in detail.

Figure 4:
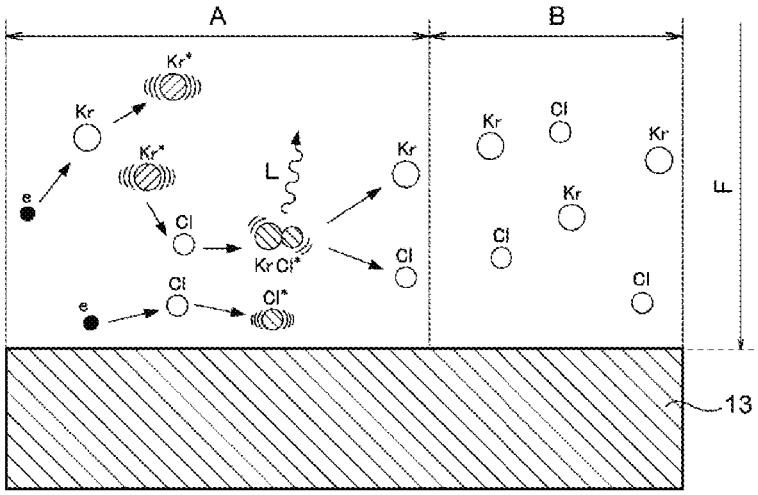
FIG. 4 schematically illustrates movements of various atoms inside the discharge vessel of the excimer lamp shown in FIG. 1.

As shown in FIG. 4, chlorine present in the discharge forming region A is excited when the discharge is formed (the discharging takes place) in the discharge forming region A, but chlorine present in the non-discharge region B where a discharge is not formed is not excited. Therefore, even if the chlorine (Cl*) excited in the discharge forming region A is driven into the discharge vessel 13 and disappears from the inside of the discharge vessel 13, chlorine (Cl) contributing to light emission is sufficiently maintained in the non-discharge region B. Thus, chlorine (Cl) is supplied from the non-discharge region B to the discharge forming region A, thereby preventing a decrease in illuminance Since the ratio of the partial pressure of the halogen gas to the partial pressure of the rare gas also influences the emission efficiency of the excimer light, it is desirable that a predetermined partial-pressure ratio is maintained. For example, the partial pressure ratio ($P_{Cl}/P_{Kr}$) of the partial pressure ($P_{Cl}$) of chlorine gas ($Cl_2$) relative to the partial pressure ($P_{Kr}$) of krypton is set in a range from 0.5% to 5%. Even if the excited chlorine atoms (Cl*) are driven into the discharge vessel 13 and disappear from the inside of the discharge vessel 13, it is possible to prevent the partial pressure ratio of the halogen gas to the rare gas from fluctuating significantly as long as the non-discharge regions (B) is large enough. If the partial pressure ratio of the halogen gas to the rare gas does not change significantly, it is possible to maintain a stable light source. In FIG. 4, "F" designates an inner diameter of the discharge vessel 13.

Thus, the non-discharge region B can function as a reservoir of chlorine atoms (Cl). Therefore, it is possible to increase an amount of halogen loaded in the discharge vessel 13 while maintaining a predetermined gas pressure of the halogen in the discharge vessel (halogen atom partial pressure), and prolong the light-emission life of the excimer lamp.

Specifically, by deciding the spatial surface area Sd [$mm^2$] of the discharge forming region A and the halogen-atoms partial pressure Ph [Torr] to be sealed in the discharge vessel with respect to the total space volume (Vb) inside the discharge vessel 13 (including the discharge forming region A and the non-discharge region B), the light-emission lifetime can be improved based on the calculation formula of $(Vb \times Ph)/Sd$. The total space volume may occasionally be referred to as the space volume in this specification.

When supplying halogen into the discharge vessel 13, a halogen gas or a halogen compound can be used. The halogen that contributes to the discharging is a gas, and the halogen is loaded with reference to the value of the halogen-atoms partial pressure [Torr] in the discharge vessel. Examples of the halogen include chlorine gas ($Cl_2$), hydrogen chloride (HCl) and the like if chlorine atoms are used.

In this specification, the halogen-atoms partial pressure is a partial pressure value of halogen atoms. The halogen-atoms partial pressure corresponds to a partial pressure of an enclosed gas if the halogen is hydrogen chloride (HCl), and corresponds to a double of a partial pressure of an enclosed gas if the halogen is chlorine gas ($Cl_2$)

As the ratio of the non-discharge region B to the space volume (Vb) of the discharge vessel increases, it is possible to increase an amount of halogen that can be stored in the non-discharge region B without being excited. In other words, if the space volume of the discharge forming region A (Vd) decreases relative to the space volume (Vb) of the discharge vessel, the numerical value derived from the calculation formula $(Vb \times Ph)/Sd$ [Torr·mm] can be set high. This contributes to obtaining a good light-emission lifetime without excessively increasing the halogen-atoms partial pressure [Torr].

Therefore, it is desirable that the space volume (Vd) of the discharge forming region A is set to, for example, 80% or less, 75% or less, or even 70% or less, with respect to the space volume (Vb) inside the discharge vessel including the discharge forming region A and the non-discharge region B. Results of the verification test (will be described later) revealed that a good life characteristics was obtained when the ratio (Vd/Vb) of the space volume (Vd) of the discharge forming region A to the space volume (Vb) of the discharge vessel was 73%. It was also confirmed that as the volume ratio (Vd/Vb) decreased, the life characteristics were likely to be improved.

As described above, if the ratio of the non-discharge region B increases, it is possible to increase an amount of halogen enclosed in the discharge vessel while suppressing the partial pressure of halogen atoms.

As the ratio of the non-discharge region B to the discharge forming region A increases, the halogen-atoms partial pressure in the discharge vessel hardly fluctuates even if halogen atoms excited in the discharge forming region A are absorbed by the discharge vessel to decrease the halogen atoms from the discharge vessel. This is because halogen atoms are not excited and stay in the non-discharge region B. Thus, the increased ratio of the non-discharge region B relative to the discharge forming region A suppresses the change in light-emission characteristics due to the variation in the partial pressure of halogen atoms, reduces the variation in the partial pressure ratio of the halogen gas partial pressure to the rare gas partial pressure, avoids no-generation of the excited complex, and suppresses the influence of the decrease in illuminance.

The verification experiment was carried out to confirm a change in the life characteristics of an excimer lamp, which was filled with krypton gas (Kr) and chlorine gas ($Cl_2$) as the light emission gases, with the changing ratio of the non-discharge region B. The results are shown in FIG. 5.

In FIG. 5, the "Life" represents the lighting time until the illuminance of the excimer lamp drops to 50% of an initial value of illuminance. 2,500 hours is the upper limit of the "Life." The illuminance was measured with an illuminance meter (UIT-250) manufactured by Ushio Denki Co., Ltd. An illuminance sensor (VUV-S172) manufactured by Ushio Denki Co., Ltd. was attached to the illuminance meter (UIT-250). The illuminance meter was disposed at a position spaced 50 mm from the discharge vessel. Fifteen excimer lamps were tested.

In the excimer lamp using a rare gas and halogen, the partial pressure ratio of halogen to a total gas pressure in the discharge vessel was adjusted to a constant value in consideration of the possibility that the partial pressure ratio of halogen to the enclosed gas pressure affects the life characteristics of the discharge vessel. Here, the total gas pressure including the rare gas pressure, the halogen gas pressure, the buffer gas, etc. was in the range from 60 to 300 [Torr]. The rare gas and the halogen gas are light emission gases in the discharge vessel. The partial gas pressure [Torr] of $Cl_2$ to the total gas pressure was adjusted to about 1%.

As can be seen from the verification results (Nos. 5, 8, and 11 to 15) shown in FIG. 5, it was confirmed that good life characteristics were obtained when the value of M/Sd (Torr·m) was equal to or greater than 4.50. The value M is obtained by multiplying Vb by Ph. Vb represents the space volume (bulb volume) [$mm^3$] inside the discharge vessel including the discharge forming region A and the non-discharge region B. Ph represents the Cl atoms partial pressure [Torr]. M represents an amount of chlorine filled in the discharge vessel. Sd represents the bulb inner surface area [$mm^2$] in the discharge forming region A.

$$(Vb \times Ph)/Sd \geq 4.50 \quad (1)$$

Here, the Cl atoms partial pressure Ph [Torr] is a value obtained by doubling the gas partial pressure [Torr] of the chlorine gas ($Cl_2$).

Further, it was confirmed that as the volume ratio (Vd/Vb) decreases, the numerical value M/Sd (Torr·mm) tends to increase. Vb [$mm^3$] represents the space volume (bulb volume) inside the discharge vessel. Vd [$mm^3$] represents the space volume (discharge space volume) of the discharge forming region A. It was confirmed that the lifetime characteristics of the lamp were excellent if the volume ratio (Vd/Vb) was 0.73 or less.

$$Vd/Vb \leq 0.73 \quad (2)$$

Further, when Vd/Vb is equal to or smaller than 0.60, the numerical value M/Sd [Torr·mm] of can be set high, and better life characteristics can be obtained. When Vd/Vb was equal to or smaller than 0.57, better life characteristics were obtained, and the life of the lamp exceeded 2500 hours, which was the upper limit of the life test (No. 12 to No. 14).

In general, if the excimer lamp relies upon the discharging, the excimer lamp is designed such that the non-discharge region B, in which no discharging takes place, be small as much as possible, and the discharge forming region A, in which discharging takes place, be large as much as possible.

In this embodiment, on the other hand, the excimer lamp has the large non-discharge region B, as described above, and can obtain good lifetime characteristics of lighting. It is presumed that if the non-discharge region B is large, the partial pressure of chlorine atoms in the discharge vessel hardly fluctuates, i.e., chlorine is retained in the non-discharge region B, such that the influence of chlorine consumption in the discharge forming region A is reduced even when chlorine is consumed in the discharge forming region A.

It should also be noted that even if the non-discharge region B is large, good lifetime characteristics are hardly obtained when the partial pressure of chlorine atoms enclosed in the discharge vessel is low. This is probably because an amount of chlorine enclosed in the discharge vessel is too small to the discharge volume Vd.

The inventor found that the calculation formula (formula (1)), which includes the value of the partial pressure Ph of chlorine atoms in addition to the discharge volume Vd and the bulb volume Vb, has a high correlation with the lifetime characteristic of the light source (excimer lamp), and confirmed that a good lifetime characteristic of the excimer lamp is obtained when the value calculated by the calculation formula (1) is equal to or greater than 4.50.

How To Measure Partial Pressure Of Halogen Atoms

The halogen-atoms partial pressure in this specification is a partial pressure value of halogen atoms, and is calculated from the inner volume (space volume) of the discharge vessel and an amount of halogen present in the discharge vessel.

A method of measuring an amount of halogen may be an ion chromatography method, a titration method, or a combination of the ion chromatography method and the titration method, depending upon the gas components. Specifically, an appropriate amount of a liquid sample piece is extracted from a liquid sample in which a light emitting gas component in a discharge vessel is dissolved in pure water, and an ionic component contained in the liquid sample piece is detected. If the ion chromatography method and the titration method are used in combination, a plurality of liquid sample pieces are extracted from the above-mentioned liquid sample, and an ion component contained in each of the liquid sample pieces is detected by the ion chromatography method and the titration method, respectively.

The inventor also checked the contact area between the discharge vessel and the electrodes and found that the emission lifetime improves as the contact area between the discharge vessel and the electrodes becomes smaller. The inventor assumes that this is because it is likely that the excited Cl(Cl*) be driven into the bulb (discharge vessel) in those region(s) of the discharge vessel which contact the electrodes.

Figure 6:
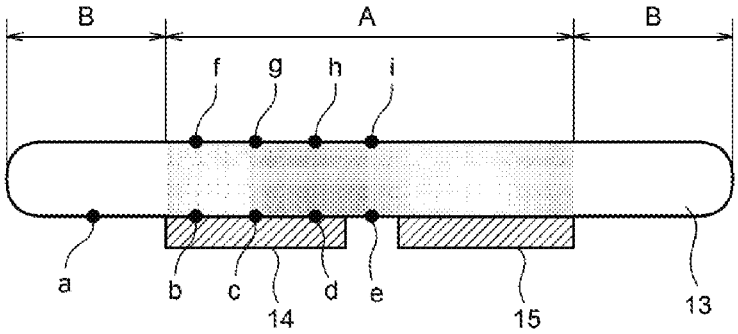
FIG. 6 shows measuring points of chlorine concentrations.

A verification experiment was carried out with the discharge vessel 13 as shown in FIG. 6. Specifically, the ratio of an amount of chlorine contained in the bulb of the discharge vessel 13 after lighting was measured by X-ray photoelectron spectroscopy (XPS) at nine positions a to i, i.e., the position a facing the non-discharge region B and the positions b to i facing the discharge forming region A. The results are shown in FIG. 7.

In this verification experiment, only the first electrode 14 was turned on (lit) with high voltage (high voltage on one side) for 600 hours, and the chlorine concentration was measured at each of the positions a to i around the first electrode 14.

Figure 7:
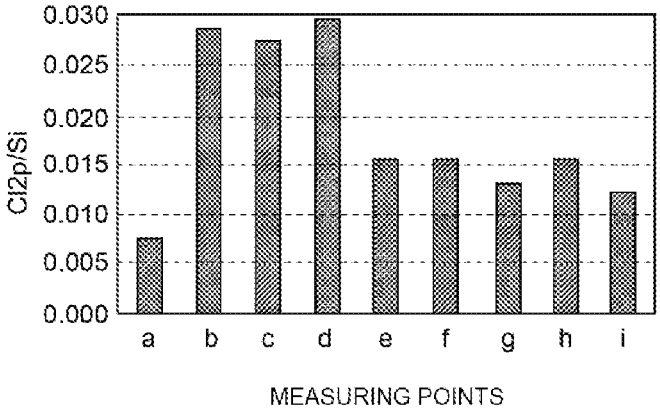
FIG. 7 is the measurement result of the chlorine concentration.

As shown in FIG. 7, it was confirmed that the chlorine concentration was higher at the positions b to i facing the discharge forming region A than at the position a facing the non-discharge region B.

It was also confirmed, with regard to the positions b to i facing the discharge forming region A, that the chlorine concentration was generally lower at the positions e to i that were not in contact with the first electrode 14 than at the positions b to d that were in contact with the first electrode 14.

In an excimer lamp, discharge is easily concentrated as a high voltage is applied to the electrode(s). Since the electrons jump between the electrodes, it is presumed that many of the chlorine (Cl*) excited by the collision of the electrons also moves toward the electrodes. Therefore, it is considered that excited Cl(Cl*) is likely to be implanted into the bulb in the area contacting the electrodes.

In the above-described verification experiment, only the first electrode 14 was supplied with the high voltage and the lamp was lit (one-side high-voltage). If high voltage is applied to the second electrode 15, the same measurement results are obtained for the respective measuring positions (points) of the second electrode 15.

From the above-described verification results, it is understood that by reducing the contact area between the discharge vessel and the electrodes, the consumption of halogen inside the discharge vessel is reduced. Therefore, when the electrodes are arranged on the outer surface of the discharge vessel, it is important to reduce the electrode width.

For example, if the contact area between the discharge vessel and the first and second electrodes is set to 50% or less of the outer surface area of the discharge vessel, the consumption of halogen in the discharge vessel can be reduced satisfactorily. It should be noted, however, that the formation of the discharging becomes difficult as the electrode width is reduced. Thus, it is necessary to consider the balancing between the emission characteristics of the excimer lamp and how much the contact area between the discharge vessel and the first and second electrodes should be reduced.

When the two electrodes 14 and 15 are arranged on the same surface of the discharge vessel 13 as in the embodiment shown in FIG. 2 and FIG. 3, the discharge forming region A can be formed wide while suppressing the contact areas 13*s* between the discharge vessel 13 and the electrodes 14 and 15.

As described above, the excimer lamp 12 of this embodiment includes the discharge vessel 13 in which the rare gas and the halogen are enclosed and sealed as the light emitting gases, and a pair of electrodes 14 and 15 for generating a dielectric barrier discharge. The excimer lamp 12 of this embodiment is a KrCl excimer lamp using krypton (Kr) as the rare gas and chlorine gas ($Cl_2$) as the halogen gas, and emits light having a center wavelength of 222 nm.

The discharge vessel 13 has the discharge forming region A in which discharge is formed. The discharge forming region A is defined in the inner space of the discharge vessel between the first electrode 14 and the second electrode 15. The discharge vessel 13 also has the non-discharge regions B which communicate with the discharge forming region A and in which discharge is not formed. The space volume of the discharge forming region A is set to 80% or less of the space volume inside the discharge vessel 13 including the discharge forming region A and the non-discharge regions B.

Further, when the volume of the space inside the discharge vessel 13 is represented by Vb, the surface area inside the bulb in the discharge forming region A is represented by Sd, and the partial pressure of Cl atoms enclosed in the discharge vessel 13 is represented by Ph, (Vb×Ph)/Vd is set to be equal to or greater than 4.50.

As described above, a region in which no discharge is formed inside the discharge vessel 13 is intentionally formed large, and chlorine atoms are enclosed in the discharge vessel 13 without excess and deficiency. Thus, it is possible to retain chlorine in the discharge vessel 13 without exciting chlorine, thereby reducing the disappearing (consumption) of chlorine. Further, even if the chlorine atoms excited in the discharge forming region A are driven into the discharge vessel 13 and disappear from the discharge vessel 13, it is possible to prevent the partial pressure ratio of the halogen gas to the rare gas from largely fluctuating because a sufficient amount of chlorine atoms is retained in the discharge vessel 13. Therefore, it is possible to appropriately suppress the illuminance decrease and prolong the light-emission life of the excimer lamp.

The space volume of the discharge forming region A is preferably equal to or smaller than 60% of the space volume inside the discharge vessel 13. This configuration imparts better life characteristics to the excimer lamp.

Furthermore, the contact area between the discharge vessel 13 and the first and second electrodes 14 and 15 may be equal to or smaller than 50% of the outer surface area of the discharge vessel 13. This configuration reduces the implantation of chlorine into the discharge vessel 13 and suppresses the consumption of chlorine.

As described above, the excimer lamp 12 of the above-described embodiment encloses and seals the rare gas and the halogen as the light emitting gases in the discharge vessel, and can be a light source whose life of light emission is extended.

Modified Embodiments

As shown in FIG. 2 and FIG. 3, the excimer lamp 12 of the above-described embodiment has a pair of electrodes (first electrode 14 and second electrode 15) that are disposed on one surface (rear surface) of the discharge vessel 13. However, the configuration of the excimer lamp of the invention is not limited to the above-described configuration. Exemplary modifications to the above-described embodiment will be described below with reference to FIG. 8 to FIG. 17.

Figure 8:
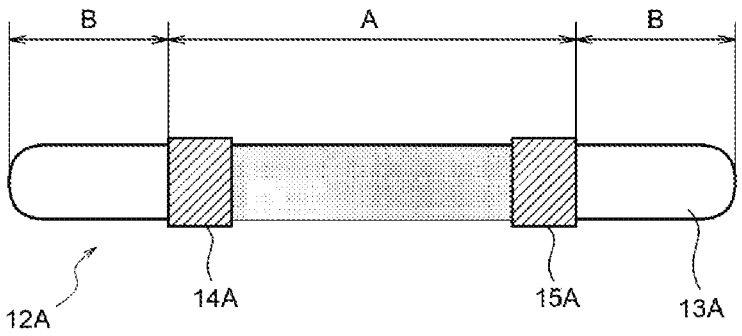
FIG. 8 schematically shows another example of the excimer lamp.
Figure 9:
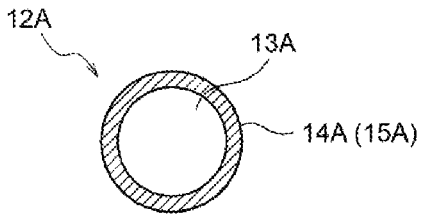
FIG. 9 schematically shows the excimer lamp of FIG. 8 when viewed in the axial direction of the light emitting tube.

A first modification is illustrated in FIG. 8 and FIG. 9. FIG. 8 is similar to FIG. 2, and FIG. 9 is similar to FIG. 3. As shown in FIG. 8 and FIG. 9, an excimer lamp 12A according to the first modification may have a pair of annular electrodes (first electrode 14A and second electrode 15A) disposed around a tube-shaped discharge vessel 13A near opposite ends of the discharge vessel 13A. In this configuration, as shown in FIG. 8, a discharge forming region A is formed between the two electrodes 14A and 15A, and two non-discharge regions B, which communicate with the discharge forming region A, are formed outside the discharge forming region A.

Figure 10:
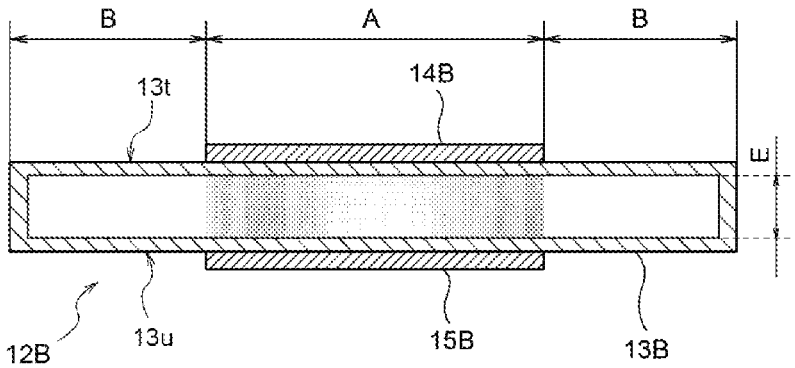
FIG. 10 is a schematic cross-sectional view of still another excimer lamp when cut in the longitudinal direction of the excimer lamp.
Figure 11:
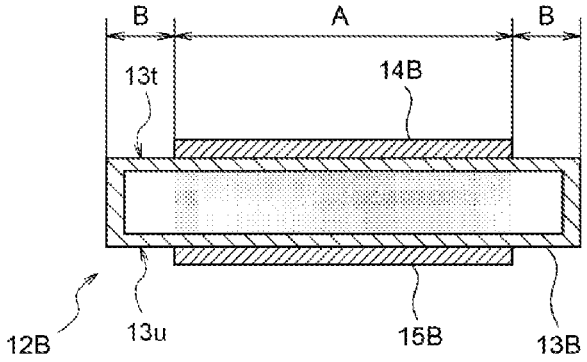
FIG. 11 is a schematic cross-sectional view of the excimer lamp of FIG. 10 when cut in the width direction.

A second modification is illustrated in FIG. 10 and FIG. 11. A discharge vessel 13B of the second modification has a flat box shape. FIG. 10 is a cross-sectional view which is obtained by cutting the discharge vessel 13B in the longitudinal direction of the discharge vessel. FIG. 11 is a cross-sectional view which is obtained by cutting the discharge vessel 13B in a direction perpendicular to the longitudinal direction of the discharge vessel. As shown in FIG. 10 and FIG. 11, an excimer lamp 12B according to the second modification may have the flat discharge vessel 13B, and the flat discharge vessel 13B has a first major surface 13*t* and a second major surface 13*u*. An inner space having a height E is defined between the first major surface 13*t* and the second major surface 13*u*. The first electrode 14B is arranged on the first major surface 13*t* and the second electrode 15B is arranged on the second major surface 13*u*. In this configuration, the region sandwiched by the two electrodes 14B and 15B becomes the discharge forming region A. The two non-discharge regions B, which communicate with the discharge forming region A, are formed outside the discharge forming region A. The non-discharge regions B are formed at opposite ends of the discharge vessel 13B in the axial direction of the discharge vessel 13B as shown in FIG. 10. As shown in FIG. 11, the non-discharge regions B are formed at opposite ends of the discharge vessel 13B in the width direction of the discharge vessel 13B.

Figure 12:
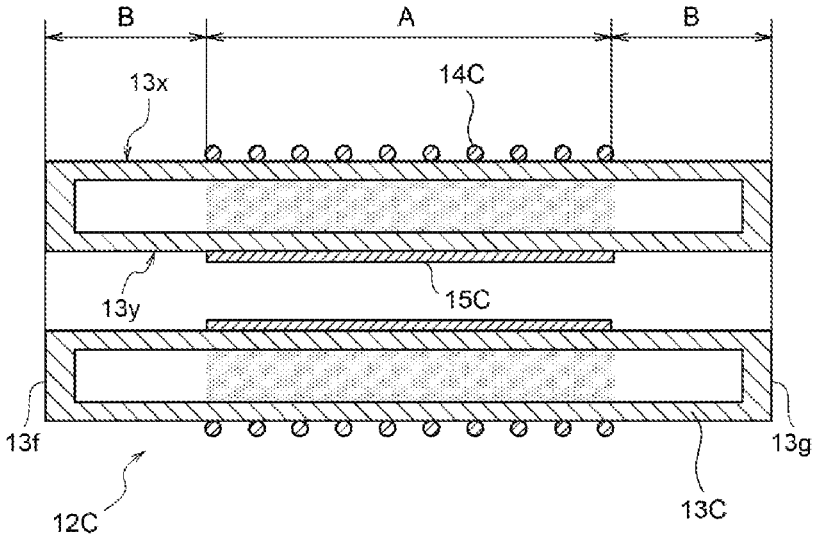
FIG. 12 is a schematic cross-sectional view of yet another excimer lamp when cut in the axial direction of the light emitting tube.
Figure 13:
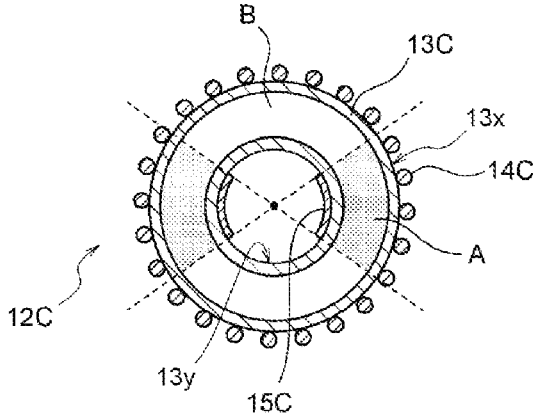
FIG. 13 is a schematic cross-sectional view of the excimer lamp of FIG. 12 taken in the direction perpendicular to the axial direction of the light emitting tube.

A third modification is illustrated in FIG. 12 and FIG. 13. FIG. 12 is a cross-sectional view which is obtained by cutting a discharge vessel 13C in the longitudinal direction of the discharge vessel. FIG. 13 is a cross-sectional view which is obtained by cutting the discharge vessel 13C in a direction perpendicular to the longitudinal direction of the discharge vessel. As shown in FIG. 12 and FIG. 13, an excimer lamp 12C according to the third modification may include the discharge vessel 13C that has a double tube structure. The discharge vessel 13C includes a cylindrical outer tube 13*x* and a cylindrical inner tube 13*y*. The inner tube 13*y* is coaxial with the outer tube 13*x* and present inside the outer tube 13*x*. The inner tube 13*y* has a smaller diameter than the outer tube 13*x*. The outer tube 13*x* and the inner tube 13*y* are sealed by end portions 13*f* and 13*g* in the lateral direction of FIG. 12, and an annular inner space is formed between the outer tube 13*x* and the inner tube 13*y*. A first electrode (outer electrode) 14C is disposed on the outer surface of the outer tube 13*x*. The first electrode 14C has a net shape. A second electrode (inner electrode) 15C is disposed on the inner surface of the inner tube 13*y*. The second electrode 15C has a film shape. As shown in FIG. 13, the first electrode 14C is provided around the entire outer surface of the outer tube 13*x*, and the second electrode 15C is divided into two pieces and provided on certain portions of the inner surface of the inner tube 13*y*. In this configuration, two regions sandwiched by the electrodes 14C and 15C become the discharge forming regions A, and two non-discharge regions B, which communicate with the discharge forming regions A, are formed outside the discharge forming regions A.

Figure 14:
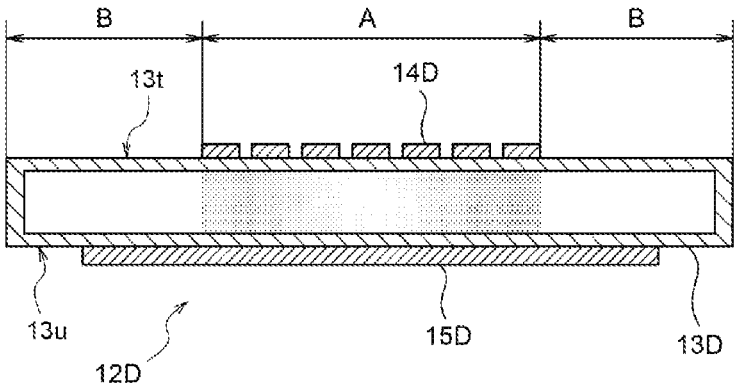
FIG. 14 is a schematic cross-sectional view of another excimer lamp when cut in the longitudinal direction of the excimer lamp.
Figure 15:
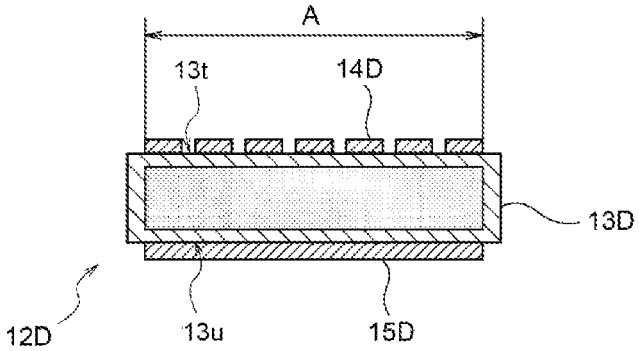
FIG. 15 is a schematic cross-sectional view of the excimer lamp of FIG. 14 when cut in the width direction.

A fourth modification is illustrated in FIG. 14 and FIG. 15. FIG. 14 is similar to FIG. 10, and FIG. 15 is similar to FIG. 11. The excimer lamp 12D according to the fourth modification may have the flat discharge vessel 13D. The first electrode 14D and the second electrode 15D are arranged on the first major surface 13*t* and the second major surface 13*u* of the flat discharge vessel 13D, respectively. The first electrode 14D is an electrode member formed in a predetermined pattern by means of the printed electrode, and the second electrode 15D is a plate-shaped electrode member formed in a wider area than the first electrode 14D. In this configuration, the region sandwiched by the two electrodes 14D and 15D becomes the discharge forming region A, and the two non-discharge regions B communicating with the discharge forming region A are formed outside the discharge forming region A. As shown in FIG. 15, the region B are not formed in the discharge vessel 13D when viewed in the width direction of the discharge vessel 13D.

Figure 16:
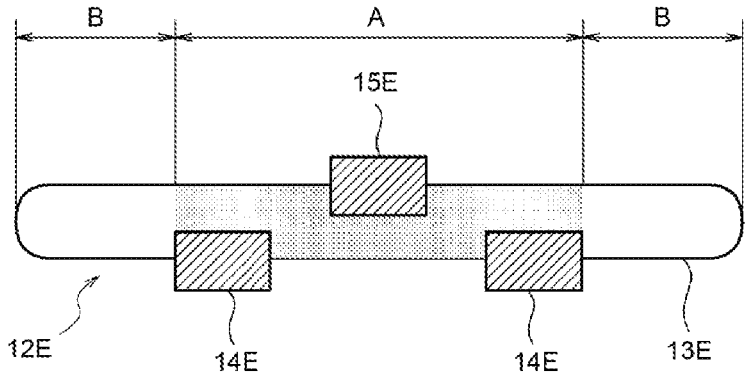
FIG. 16 is similar to FIG. 2 and schematically shows another excimer lamp.
Figure 17:
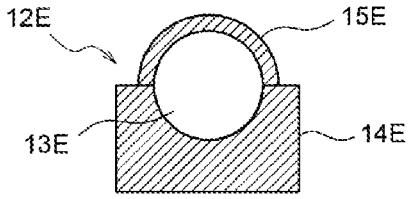
FIG. 17 is similar to FIG. 3 and schematically shows the excimer lamp of FIG. 16 when viewed in the axial direction of the light emitting tube.
Figure 18:
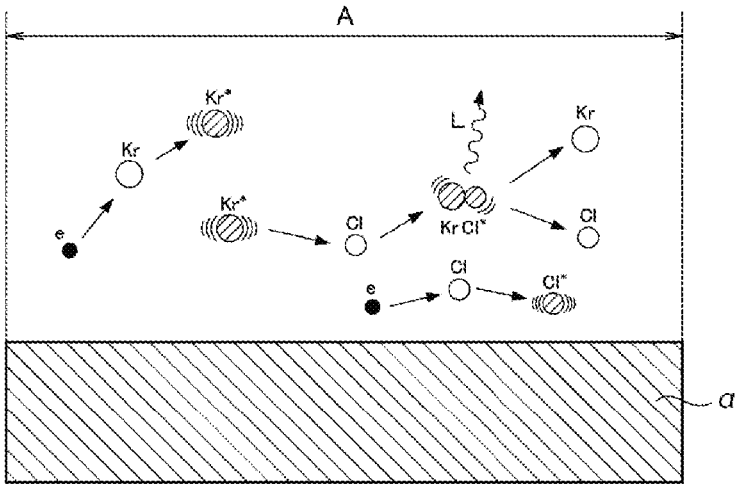
FIG.18 PRIOR ART
FIG. 18 shows movements of various atoms inside a discharge forming region of a KrCl excimer lamp.

A fifth modification is illustrated in FIG. 16 and FIG. 17. FIG. 16 is similar to FIG. 2, and FIG. 17 is similar to FIG. 3. An excimer lamp 12E according to the fifth modification may have a plurality of first electrodes 14E arranged on the rear surface of a tube-shaped discharge vessel 13E. In FIG. 16, the two first electrodes 14E and 14E are disposed on the rear surface (first surface) with a predetermined distance. The first electrodes 14E have the same polarity and are arranged at the two different positions on the rear surface of the discharge vessel 13E. A single second electrode 15E is arranged on the front surface (second surface) of the discharge vessel 13E at a position not facing the first electrodes 14E. In this configuration, the inner space region between the positions of the first electrodes 14E and the position of the second electrode 15E becomes the discharge forming region A. The two non-discharge regions B communicating with the discharge forming region A are formed outside the discharge forming region A.

In the above-described embodiment, the excimer lamp 12 is a KrCl excimer lamp and Kr is the rare gas. It should be noted, however, that the present invention is also applicable to an excimer lamp containing a rare gas and halogen other than Kr and Cl. For example, the excimer lamp 12 may be a XeCl excimer lamp, a XeBr excimer lamp, a KrBr excimer lamp, or the like. In such excimer lamps, the ratio of the non-discharge region(s) B to the discharge forming region A is intentionally increased in the discharge vessel, and a predetermined amount of halogen is loaded into the discharge vessel. Then, it becomes possible to prolong the light emission life of the excimer lamp, as in the above-described embodiment.

While certain embodiments and modifications have been described, these embodiments and modifications have been presented by way of examples only, and are not intended to limit the scope of the present invention. The novel apparatuses and methods thereof described herein may be embodied in a variety of other forms; furthermore, various omissions, substitutions and changes in the form of the apparatuses and methods thereof described herein may be made without departing from the gist of the present invention. The appended claims and their equivalents are intended to cover such forms or modifications as would fall within the scope and gist of the present invention.

The present application is based upon and claims the benefit of a priority from Japanese Patent Application No. 2020-144409, filed Aug. 28, 2020, and the entire content of which is incorporated herein by reference.

What is claimed is:

1. An excimer lamp comprising:

a discharge vessel in which a rare gas and a halogen are enclosed and sealed as light emitting gases; and at least one first electrode and at least one second electrode for generating a dielectric barrier discharge inside the discharge vessel, the rare gas being xenon or krypton, the discharge vessel having a discharge forming region and a non-discharge region therein such that discharging takes place in the discharge forming region and no discharging takes place in the non-discharge region, the discharge forming region being formed between the at least one first electrode and the at least one second electrode, the non-discharge region communicating with the discharge forming region, the excimer lamp being configured to satisfy following equations:

$$(Vb \times Ph)/Sd \geq 4.50$$

$$Ph \leq 5.0$$

where Vb [$mm^3$] represents a space volume inside the discharge vessel, Sd [$mm^2$] represents an inner surface area of the discharge vessel in the discharge forming region, and Ph [Torr] represents a halogen-atoms partial pressure enclosed in the discharge vessel.

2. The excimer lamp according to claim 1, wherein the space volume of the discharge forming region is equal to or smaller than 73% of the space volume inside the discharge vessel including the discharge forming region and the non-discharge region.

3. The excimer lamp according to claim 1, wherein the space volume of the discharge forming region is equal to or smaller than 60% of the space volume inside the discharge vessel including the discharge forming region and the non-discharge region.

4. The excimer lamp according to claim 1, wherein the at least one first electrode and the at least one second electrode are disposed in contact with an outer surface of the discharge vessel.

5. The excimer lamp according to claim 4, wherein a contact area between the discharge vessel and the at least one first and second electrodes is equal to or smaller than 50% of an outer surface area of the discharge vessel.

6. The excimer lamp according to claim 1, wherein the halogen is a chlorine gas.

7. The excimer lamp according to claim 1, wherein the discharge vessel is made of quartz glass.

8. The excimer lamp according to claim 2, wherein the space volume of the discharge forming region is equal to or smaller than 60% of the space volume inside the discharge vessel including the discharge forming region and the non-discharge region.

9. The excimer lamp according to claim 2, wherein the at least one first electrode and the at least one second electrode are disposed in contact with an outer surface of the discharge vessel.

10. The excimer lamp according to claim 3, wherein the at least one first electrode and the at least one second electrode are disposed in contact with an outer surface of the discharge vessel.

11. The excimer lamp according to claim 9, wherein a contact area between the discharge vessel and the at least one first electrode and the at least one second electrode is equal to or smaller than 50% of an outer surface area of the discharge vessel.

12. The excimer lamp according to claim 10, wherein a contact area between the discharge vessel and the at least one first electrode and the at least one second electrode is equal to or smaller than 50% of an outer surface area of the discharge vessel.

13. The excimer lamp according to claim 1, wherein the at least one first electrode and the at least one second electrode are disposed on an outer surface of the discharge vessel such that the at least one second electrode is spaced from the at least one first electrode in a longitudinal direction of the discharge vessel.

14. The excimer lamp according to claim 1, wherein the discharge vessel has a double-tube structure having an outer tube and an inner tube that is coaxial to the outer tube, the at least one first electrode is disposed on the outer tube and the at least one second electrode is disposed on the inner tube.

15. The excimer lamp according to claim 1, wherein the at least one first electrode includes two first electrodes and the at least one second electrode includes one second electrode, and the two first electrodes are disposed on a first surface of the discharge vessel with a predetermined distance, and the second electrode is disposed on a second surface of the discharge vessel, which is opposite to the first surface of the discharge vessel.

* * * * *